US005453342A

United States Patent [19]

Go et al.

[11] Patent Number: 5,453,342

[45] Date of Patent: Sep. 26, 1995

[54] ELECTROPHOTOGRAPHIC PHOTOSENSITIVE MEMBER, AND ELECTROPHOTOGRAPHIC APPARATUS, DEVICE UNIT, AND FACSIMILE MACHINE EMPLOYING THE SAME

[75] Inventors: Shintetsu Go; Yoshio Kashizaki, both of Yokohama; Koichi Suzuki, Kawasaki; Satomi Ohmura, Kawasaki; Masato Tanaka, Kawasaki, all of Japan

[73] Assignee: Canon Kabushiki Kaisha, Tokyo, Japan

[21] Appl. No.: 813,570

[22] Filed: Dec. 26, 1991

[30] Foreign Application Priority Data

Dec. 26, 1990 [JP] Japan ..... 2-406669

[51] Int. Cl.[6] ..... G03G 15/02

[52] U.S. Cl. ..... 430/58; 430/57; 430/72; 430/75; 355/271; 355/296

[58] Field of Search ..... 430/58, 57, 72, 430/75; 355/271, 296

[56] References Cited

U.S. PATENT DOCUMENTS 4,717,636 1/1988 Takahashi et al. ..... 430/58

FOREIGN PATENT DOCUMENTS 0329366 8/1989 European Pat. Off. .
498448 8/1992 European Pat. Off. .
2580830 10/1986 France .
61-149959 7/1986 Japan .
62-30254 2/1987 Japan .
1239562 9/1989 Japan .
2146551 6/1990 Japan .

*Primary Examiner*—Marion E. McCamish
*Assistant Examiner*—Mark A. Chapman
*Attorney, Agent, or Firm*—Fitzpatrick, Cella, Harper & Scinto

[57] ABSTRACT

An electrophotographic photosensitive member includes an electroconductive support and a photosensitive layer formed thereon, the photosensitive layer containing a resin having the acetal moiety represented by the formula [I] below:

[I]

wherein $R_1$, $R_2$, $R_3$, $R_4$, and $R_5$ are independently a hydrogen atom, a fluorine atom, or a trifluoromethyl group, respectively, provided that all of $R_1$, $R_2$, $R_3$, $R_4$, and $R_5$ are not simultaneously hydrogen atoms.

13 Claims, 1 Drawing Sheet

ELECTROPHOTOGRAPHIC PHOTOSENSITIVE MEMBER, AND ELECTROPHOTOGRAPHIC APPARATUS, DEVICE UNIT, AND FACSIMILE MACHINE EMPLOYING THE SAME

BACKGROUND OF THE INVENTION

1. Field of the Invention

The present invention relates to an electrophotographic photosensitive member which comprises a photosensitive layer containing a resin having a specified structure. The present invention also relates to an electrophotgraphic apparatus, a device unit, and a facsimile machine, employing the electrophotographic photosensitive member.

2. Related Background Art

In recent years, most electrophotographic photosensitive members utilizing an organic photoconductive substance are comprising a charge-generating substance of relatively low molecular weight, such as azo pigments or phthalocyanine pigments, dispersed in a suitable binder resin. Among these organic electrophotographic photosensitive members, a layered type which has functionally separated layers of a charge-generating layer containing a charge-generating substance and a charge-transporting layer containing a charge-transporting substance are widely used because of the sensitivity, potential characteristics, and durability thereof.

In the electrophotographic photosensitive members, the characteristics of the photosensitive member are mainly determined by the efficiencies of carrier-generation and carrier-transportation of the photosensitive member. In the case of the layered type, the characteristics are also determined by the efficiency of carrier-injection. These factors are considered to depend not only on the properties of the charge-generating substance and the charge-transporting substance but also on the the properties of the binder resin. Heretofore, the binder resins have been investigated mostly from the standpoints of the binding properties, the pigment dispersibility, mechanical strength, the solvent-resistance, and so on. Japanese Laid-Open Patent Application No. 62-30254 describes that the electrophotographic characteristics of a photosensitive member, such as sensitivity, potential stability, and residual potential, are affected by the structure, the functional group, the molecular weight, etc. of the binder resin, recognizing the binder resin as a functional resin.

According to the recent requirement for higher image quality and higher durability in photoelectrography, photosensitive members having more excellent properties have been pursued.

SUMMARY OF THE INVENTION

The present invention intends to provide an electrophotographic photosensitive member which has a high sensitivity and is excellent in stability and residual potential during repeated use.

The present invention also intends to provide an electrophotographic apparatus, an apparatus unit, and a facsimile machine employing the above electrophotographic photosensitive member.

The present invention provides an electrophotographic photosensitive member, comprising an electroconductive support and a photosensitive layer formed thereon, the photosensitive layer containing a resin having acetal moieties represented by the formula [I] below:

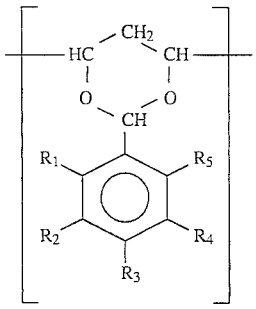

[I]

wherein $R_1$, $R_2$, $R_3$, $R_4$, and $R_5$ are independently a hydrogen atom, a fluorine atom, or a trifluoromethyl group, provided that all of $R_1$, $R_2$, $R_3$, $R_4$, and $R_5$ are not simultaneously hydrogen atoms.

The present invention also provides an electrophotographic apparatus, an apparatus unit, and a facsimile machine employing the electrophotographic photosensitive member specified above.

DESCRIPTION OF THE PREFERRED EMBODIMENT

Figure 1:
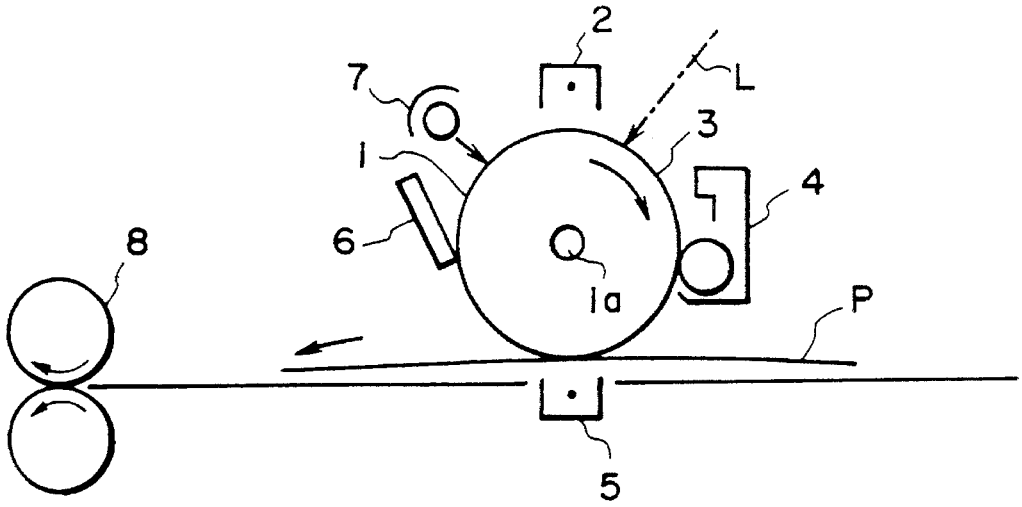
FIG. 1 illustrates outline of the constitution of an electrophotographic apparatus employing the electrophotographic photosensitive member of the present invention.

The present invention relates to an electrophotographic photosensitive member which comprises a photosensitive member containing a resin having the acetal moiety represented by the formula [I] below:

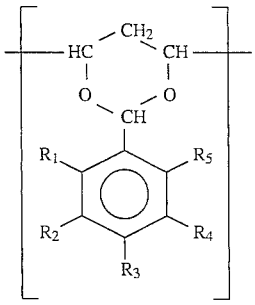

[I]

wherein $R_1$, $R_2$, $R_3$, $R_4$, and $R_5$ are independently a hydrogen atom, a fluorine atom, or a trifluoromethyl group, provided that all of $R_1$, $R_2$, $R_3$, $R_4$, and $R_5$ are not simultaneously hydrogen atoms.

The polyvinyl acetal resin having the acetal moiety represented by the formula [I] employed in the present invention has a weight-average molecular weight preferably in the range of from 10,000 to 1,000,000, more preferably from 100,000 to 500,000, and an acetalization degree of not less than 50 mol %, preferably in the range of from 70 to 90 mol %. The saponification degree of the polyvinyl alcohol for the starting material of the polyvinyl acetel resin is preferably not lower than 85%.

The presence of the polyvinyl acetal resin having the acetel moiety represented by the formula [I] in the photosensitive layer in the present invention remarkably improves the sensitivity and the potential stability in repeated use, and lowers the residual potential of the photosensitive member. This is considered to result from the improvement of the carrier-generation efficiency caused by electronic interaction of the charge-generating substance with the polyvinyl acetal resin having an electron-accepting fluorine atom or trifluoromethyl group.

In other words, the above improvement is considered to result from the fact that the polyvinyl acetal resin serves as an electron-accepting substance, raising the dissociation efficiency of the carrier by electronic interaction with the charge-generating organic compound and inhibiting the reassociation of the carrier, thereby facilitating the formation of free carriers. The above effect becomes remarkable because especially the fluorine atom or the trifluoromethyl group has significantly high electronegativity.

The typical examples of the polyvinyl acetal resins employed in the present invention are shown by the acetal moiety structure thereof. It can be understood the polyvinyl acetal resin is not limited thereto.

| Exemplified resin No. | Acetal moiety |
|---|---|
| 1 | 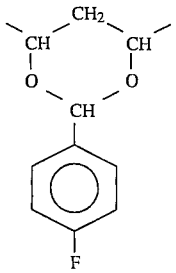 |
| 2 | 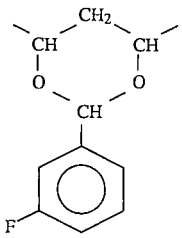 |
| 3 | 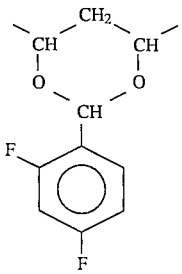 |

-continued

| Exemplified resin No. | Acetal moiety |
|---|---|
| 4 | 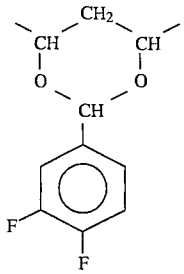 |
| 5 | 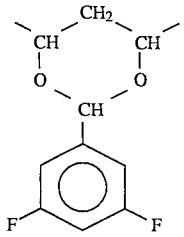 |
| 6 | 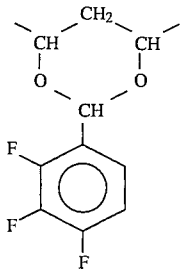 |
| 7 | 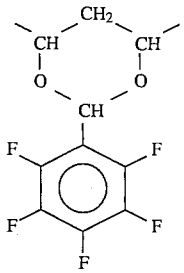 |

-continued

| Exemplified resin No. | Acetal moiety |
|---|---|
| 8 | 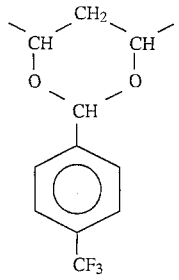 |
| 9 | 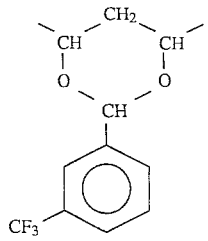 |
| 10 | 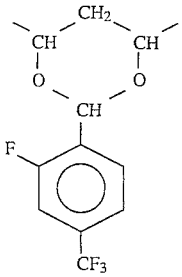 |
| 11 | 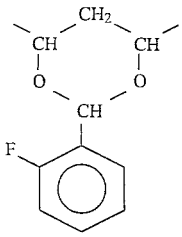 |
| 12 | 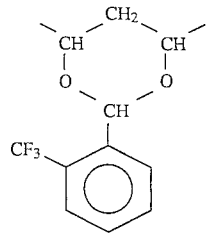 |

Of the acetal moieties Shown above, preferred are those in which $R_3$ is a fluorine atom or a trifluoromethyl group, and $R_1$, $R_2$, $R_4$, and $R_5$ are hydrogen atoms.

A synthesis example of the polyvinyl acetal resin employed in the present invention is shown below.

Synthesis Example

In a flask, 60 ml of 1,2-dichloroethane was placed. Thereto, 3.5 g of polyvinyl alcohol (polymerization degree: 1000, saponification degree: 98.5%, made by Kuraray Co., Ltd.) and 20 g of p-fluorobenzaldehyde were added. Further thereto, 0.6 ml of concentrated hydrochloric acid was added dropwise, and the mixture was heated and stirred at a temperature of from 40° to 45° C. for about 8 hours. After the reaction, the reaction solution was added dropwise to the solution of 0.3 g of sodium hydroxide in 2 liters of methanol. The precipitated resin was collected by filtration, and then dissolved in 100 ml of 1,2-dichloroethane. The solution was again added dropwise to 2 liters of methanol to precipitate the resin. The precipitated resin is collected by filtration and dried under the reduced pressure to obtain 6.1 g of white cotton-like polyacetal resin of the above exemplified resin No. 1. The resin had an acetalization degree of 81% as measured according to JIS K-6728 (Test methods of polyvinyl butyral).

Other polyvinyl acetal resins employed in the present invention may be synthesized in the same manner as described above.

The photosensitive layer of the electrophotographic photosensitive member of the present invention may be of a layered type consisting of two separate functional layers of a charge-generating layer containing a charge-generating substance and a charge-transporting layer containing a charge-transporting substance. Otherwise the photosensitive layer may be of a single layer type containing a charge-generating substance and a charge-transporting substance in one layer. The layered type photosensitive layer is preferred to the single layer type one.

In the case of the layered type, the polyvinyl acetal resin of the present invention is preferably contained at least in the charge-generating layer.

The polyvinyl acetal resin in the present invention is preferably contained in an amount of from 10 to 90% by weight, more preferably from 20 to 50% by weight of the layer containing the resin.

The polyvinyl acetal resin employed in the present invention may be used in combination with another resin. The combinedly usable resin includes resins such as polyvinyl butyral resins, polyvinyl benzal resins, polyarylate resins, polycarbonate resins, polyester resins, phenoxy resins, acrylic resins, polyacrylamide resins, polyamide resins, polyurethane resins, polystyrene resins, and acrylonitrile-styrene copolymers; and photoconductive organic polymers such as poly-N-vinylcarbazole and polyvinylanthracene. Further, copolymers of the acetal resins of the present invention and the above mentioned other resins can be used.

The charge-generating substance employed in the present invention includes azo type pigments such as monoazo dyes, bisazo dyes, and trisazo dyes; phthalocyanine type pigments such as metal phthalocyanine and non-metal phthalocyanine; indigo type dyes such as indigo and thioindigo; perylene type dyes such as perylenic anhydride and perylenimide; polycyclic quinone type pigments such as anthoanthorone and pyrene quinone; squarium type coloring matters, pyrylium salts, thiopyrylium salts, and triphenylmethane type coloring matters.

The charge-transporting substance includes electron-transporting substances and positive-hole-transporting substances. The examples of the electron-transporting substances are electron-accepting substances such as 2,4,7-trinitrofluorenone, 2,4,5,7-tetranitrofluorenone, chloranil, and tetracyanoquinodimethane; and polymers of such electron-accepting substances.

The examples of the positive-hole-transporting substances are polycyclic aromatic compounds such as pyrene and anthracene; heterocyclic compounds including carbazoles, indoles, imidazoles, oxazoles, thiazoles, oxadiazoles, pyrazoles, pyrazolines, thiadiazoles, and triazoles; hydrazone compounds such as p-diethylaminobenzaldehyde-N,N-diphenylhydrozone, and N,N-diphenylhydrazino-3-methylidene-9-ethylcarbazole; styryl compounds such as α-phenyl-4' -N,N-diphenylaminostilbene, and 5-[4-(di-p-tolylamino)benzylidene]-5H-dibenzo[a,d]cycloheptene; benzidine compounds; triarylmethanes; triphenylamine; and polymers having a radical derived from the above compound in the main chain or the side chain thereof, such as poly-N-vinylcarbazole, polyvinylanthracene, etc.

The charge-generating layer may be formed by applying, onto an electroconductive support, a coating liquid which has been prepared by dispersing a charge-generating substance as mentioned above together with the aforementioned resin, and drying it. The film thickness is preferably not more than 5 μm, more preferably in the range of from 0.01 to 1 μm.

The charge-transporting layer may be formed above or under the charge-generating layer in lamination, and in an electric field, it functions to receive charge carriers from the charge-generating layer and to transport the carriers. The charge-transporting layer may be formed by applying a solution of a charge-transporting substance and, if necessary, with an additional suitable binder resin in a solvent, and drying it. The layer thickness is preferably in the range of from 5 to 40 μm, more preferably from 15 to 30 μm.

The single layer type photosensitive layer is formed by applying, onto an electroconductive support, a coating liquid which has been prepared by dispersing or dissolving a charge-generating substance and a charge-transporting substance in a solvent, and drying it. The film thickness is preferably in the range of from 1 to 40 μm, preferably from 10 to 30 μm.

The solvent employed to make these layers includes ethers such as tetrahydrofuran and 1,4-dioxane; ketones such as cyclohexanone and methyl ethyl ketone; esters such as ethyl acetate and butyl acetate; aromatic solvents such as toluene, xylene, and monochlorobenzene; alcohols such as methanol and ethanol; aliphatic halogenated hydrocarbons such as chloroform and methylene chloride; and amides such as N,N-dimethylformamide; and the like.

The electroconductive support may be made of such a material as aluminum, aluminum alloy, copper, zinc, stainless steel, titanium, nickel, indium, gold, and platinum. Further, the electroconductive support may be a plastic on which a film of the metal or metal alloy as mentioned above is formed by vacuum vapor deposition (the plastic including polyethylene, polypropylene, polyvinyl chloride, polyethylene terephthalate, acrylic resins, and the like); or may be a plastic or metal substrate which is coated with a mixture of electroconductive particles (such as carbon black particles, and silver particles) and a suitable binder; or otherwise may be a plastic or paper sheet impregnated with electroconductive particles.

The electroconductive support may be in a shape of a sheet, a drum, a belt, or the like, a suitable shape as the electrophotographic photosensitive member.

A subbing layer having functions of a barrier and an adhesive may be provided between the electroconductive support and the photosensitive layer. The subbing layer may be formed from casein, polyvinyl alcohol, nitrocellulose, polyamide (such as nylon 6, nylon 66, nylon 610, a copolymer nylon, and alkoxymethylated nylon), polyurethane, aluminum oxide, and the like. The thickness of the subbing layer is preferably not more than 5 μm, more preferably in the range of from 0.1 to 3 μm.

Further as a protecting layer, a simple resin layer or a resin layer containing electroconductive particles may be provided on the photosensitive layer in the present invention.

The aforementioned layers may respectively be formed by a suitable coating method such as dip coating, spray coating, spinner coating, bead coating, blade coating, and beam coating.

The electrophotographic photosensitive member of the present invention in not only useful for electrophotographic copying machines but also useful for a variety of application fields of electrophotography including facsimile machines, laser beam printers, CRT printers, LED printers, liquid crystal printers, laser engraving systems, and so forth.

FIG. 1 shows a schematic diagram of a transfer type electrophotographic apparatus employing the electrophotographic photosensitive member of the present invention.

In FIG. 1, a drum type photosensitive member 1 serves as an image carrier, being driven to rotate around the axis 1*a* in the arrow direction at a predetermined peripheral speed. The photosensitive member 1 is uniformly charged, positively or negatively, at the peripheral face by an electrostatic charging means 2 during rotation, and then exposed to image-exposure light L (e.g. slit exposure, laser beam-scanning exposure, etc.) at the exposure part 3 with an image-exposure means (not shown in the figure), whereby electrostatic latent images are sequentially formed on the peripheral surface in accordance with the light image.

The electrostatic latent image is developed with a toner by a developing means 4. The toner-developed images are sequentially transferred by a transfer means 5 onto a surface of a transfer-receiving material P which is fed between the photosensitive member 1 and the transfer means 5 synchronously with the rotation of the photosensitive member 1 from a transfer-receiving material feeder not shown in the drawing.

The transfer-receiving material P having received the transferred image is separated from the photosensitive member surface, and introduced to an image fixing means 8 for fixation of the image and sent out from the copying machine as a duplicate copy.

The surface of the photosensitive member 1, after the image transfer, is cleaned with a cleaning means 6 to remove any remaining untransferred toner, and is treated for charge-clearance with a pre-exposure means 7 for repeated use for image formation.

The generally employed charging means 2 for uniformly charging the photosensitive member 1 is a corona charging apparatus. The generally and employed transfer means 5 is also a corona charging means. In the electrophotographic apparatus, two or more of the constitutional elements of the above described photosensitive member, the developing means, the cleaning means, etc. may be integrated into one apparatus unit, which may be made removable from the main body of the apparatus. For example, at least one of an electrostatic charging means, a developing means, and a cleaning means is combined together with the photosensitive member into one unit removable from the main body of the apparatus by aid of a guiding means such as a rail in the main body of the apparatus. An electrostatic charging means and/or a developing means may be combined with the aforementioned apparatus unit.

When the electrophotographic apparatus is used as a copying machine or a printer, the photosensitive member is exposed to the optical image exposure light L which is reflected light or transmitted light from an original copy, or otherwise the information read out by a sensor from an original as data signals and according to the signals light is projected by laser beam scan, by driving an LED array, or by driving a liquid crystal shutter array.

Figure 2:
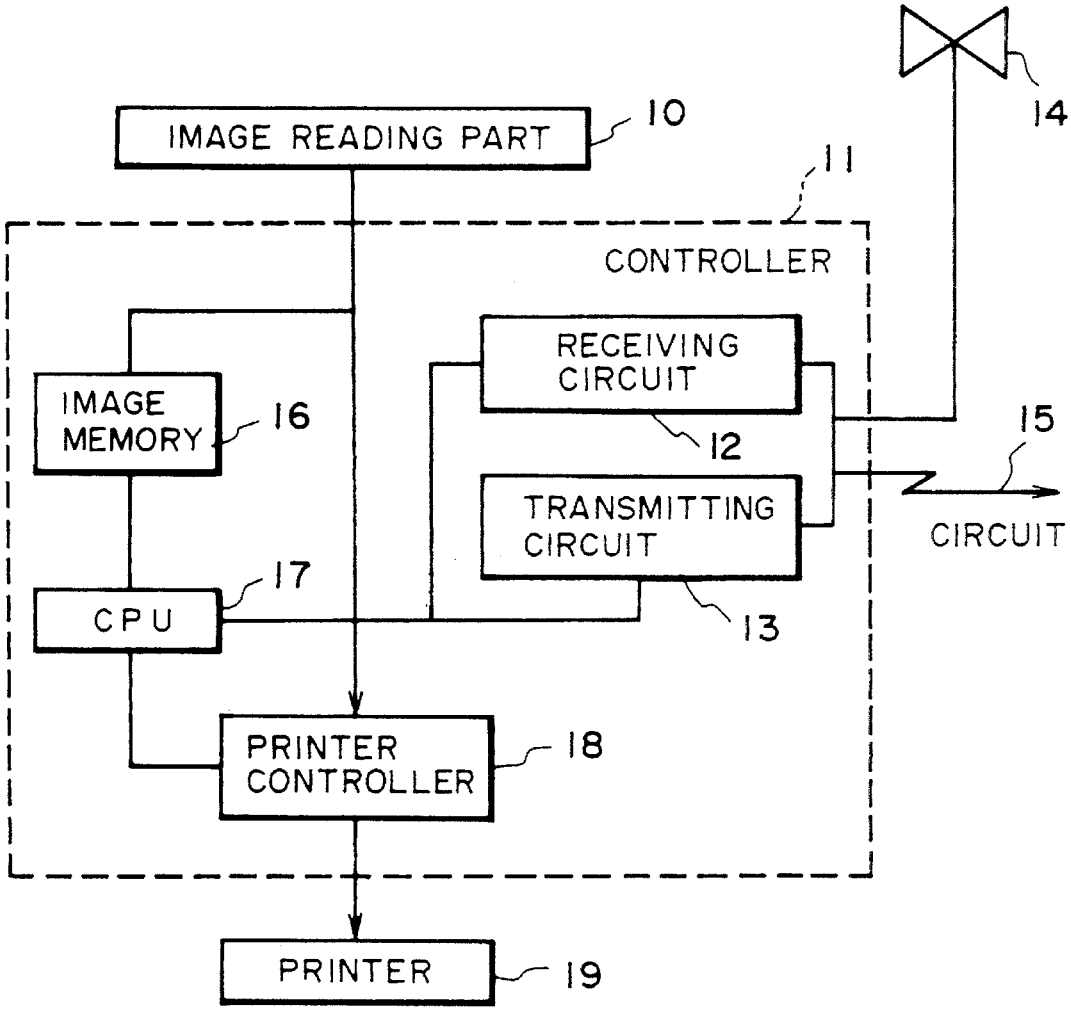
FIG. 2 illustrates a block diagram of a facsimile employing the electrophotographic photosensitive member of the present invention.

In the case where the electrophotographic apparatus is used as a printer of a facsimile machine, the optical image exposure light L is for printing the received data. FIG. 2 is a block diagram of an example of this case.

A controller 11 controls an image reading part 10 and a printer 19. The entire of the controller 11 is controlled by a CPU 17. Readout data from the image reading part is transmitted through a transmitting circuit 13 to the other communication station. Data received from the other communication station is transmitted through a receiving circuit 12 to a printer 19. The image data is stored in image memory. A printer controller 18 controls a printer 19. The numeral 14 denotes a telephone set.

The image received through a circuit 15, namely image information from a remote terminal connected through the circuit, is demodulated by the receiving circuit 12, treated for decoding of the image information in CPU 17, and successively stored in the image memory 16. When at least one page of image information has been stored in the image memory 16, the images are recorded in such a manner that the CPU 17 reads out the one page of the image information from the image memory 16, and sends out the decoded one page of information to the printer controller 18, which controls the printer 19 on receiving the one page of information from CPU 17 to record the image information.

During recording by the printer 19, the CPU 17 receives the information in the subsequent page.

Images are received and recorded in the manner as described above.

The present invention is described in more detail by reference to examples.

EXAMPLE 1

Onto an aluminum substrate, a solution of 5 g of methoxymethylated nylon resin (weight-average molecular weight: 32,000) and 10 g of alcohol-soluble copolymer nylon resin (weight-average molecular weight: 29,000) in 95 g of methanol was applied with a Meyer bar to form a subbing layer of 1 μm in dry thickness.

Separately, 5 g of the bisazo pigment having the formula below:

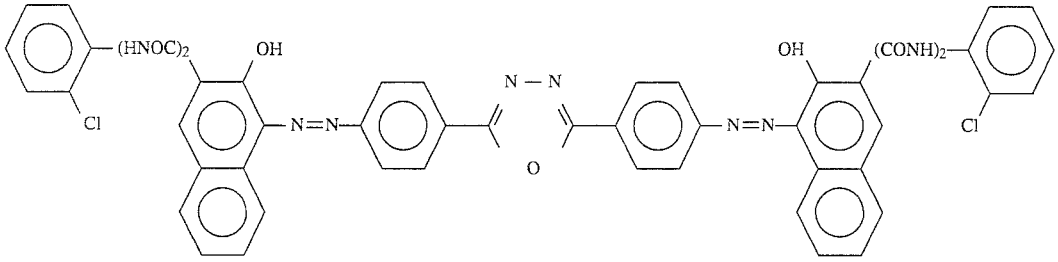

was added to 90 g of cyclohexanone, and was dispersed for 20 hours by means of a sand mill. To this dispersion, a solution of 2 g of the exemplified polyvinyl acetal resin No. 1 (weight average molecular weight 160,000) in 20 g of cyclohexanone was added and dispersed further for two hours. The resulting liquid dispersion was diluted with 200 g of methyl ethyl ketone. The diluted dispersion was applied with a Meyer bar onto the subbing layer having been formed as above and was dried to give a charge-generating layer of 0.2 μm in dry thickness.

Subsequently, 5 g of the styryl compound represented by the formula below:

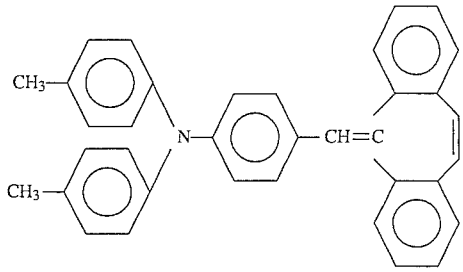

and 5 g of a polycarbonate resin (number-average molecular weight: 55,000) were dissolved in 40 g of monochlorobenzene. The solution was applied onto the above-mentioned charge-generating layer with a Meyer bar and dried to form a charge-transporting layer 20 μm thick, thereby preparing an electrophotographic photosensitive member.

This electrophotographic photosensitive member was tested for the charging characteristics by means of an electrostatic copying tester (Model SP-428, made by Kawagichi Denki K.K.) by subjecting the member to corona discharge at −5 KV to charge it negatively, leaving it in the dark for 1 second, and exposing it to light of illuminance of 10 lux by use of a halogen lamp. The charging characteristics measured were the surface potential ($V_0$) after 1 second of standing in the dark, and the amount of light exposure ($E_{1/2}$) required for the surface potential decay to one-half, as well as the residual potential (VF).

As the results, $V_0$ was −700 V, $E_{1/2}$ was 1.2 lux.sec, and VF was 0 V.

EXAMPLE 2

An electrophotographic photosensitive member was prepared and tested for charging characteristics in the same manner as in Example 1 except that the bisazo pigment of the formula below was used, and the exemplified polyvinyl acetal resin No. 7 (weight average molecular weight 170,000) was used as the binder resin.

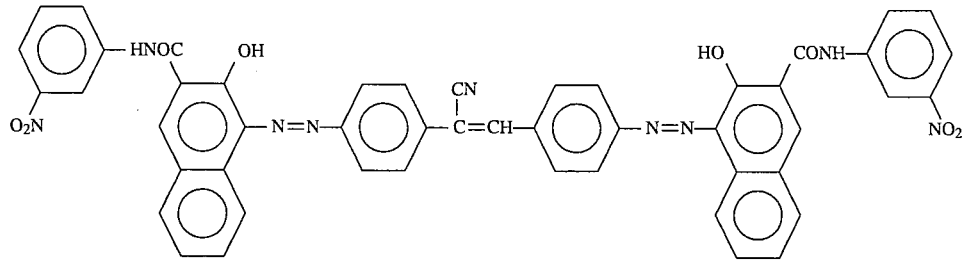

As the results, $V_0$ was −710 V, $E_{1/2}$ was 1.3 lux.sec, and Vr was 0 V.

EXAMPLE 3

An electrophotographic photosensitive member was prepared and evaluated in the same manner as in Example 1 except that the bisazo pigment represented by the formula below:

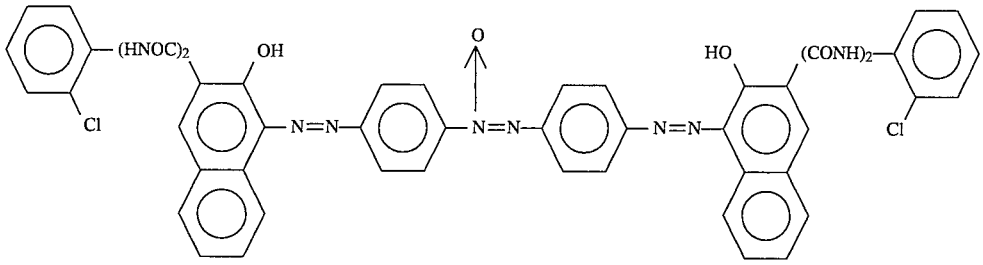

was used in place of the bisazo pigment in Example 1, tetrahydrofuran was used as the dispersion solvent, the mixed solvent of cyclohexanone and tetrahydrofuran (1:1) was used as the dilution solvent, and triarylamine represented by the formula below:

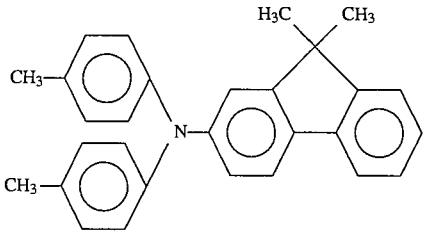

was used in place of the styryl compound.

As the results, $V_0$ was −705 V, $E_{1/2}$ was 0.8 lux.sec, and Vr was 0 V.

EXAMPLE 4

An electrophotographic photosensitive member was prepared and was tested for the charging characteristics in the same manner as in Example 1 except that the liquid dispersion for charge-generating layer formation was prepared by adding 10 g of non-metal phthalocyanine in 350 g of tetrahydrofuran, adding thereto a solution of the exemplified polyvinyl acetal resin No. 8 (weight average molecular weight 170,000, 5 g) in tetrahydrofuran (50 g), and dispersing the mixture for 10 hours by means of a sand mill.

As the results, $V_0$ was −670 V, $E_{1/2}$ was 1.8 lux.sec, and Vr was −30 V.

EXAMPLE 5

An electrophotographic photosensitive member was prepared and evaluated in the same manner as in Example 4 except that copper phthalocyanine was used in place of the non-metal phthalocyanine.

As the results, $V_0$ was −680 V, $E_{1/2}$ was 5.6 lux.sec. and Vr was −35 V.

Comparative Examples 1, 2, 3, and 4

Electrophotographic photosensitive members were prepared and evaluated in the same manner as in Example 1 except that the polyvinyl acetal resin in Example 1 was replaced by the ones having the moiety represented by the formula below:

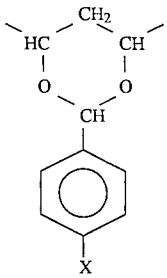

where X denotes a hydrogen atom, a nitro group, a methyl group, or a chlorine atom; and having acetalation degree of 75–80% Vr was not measured. The results are shown in Table 1.

TABLE 1

| Comparative Example No. | X | $V_O$ (−V) | $E_{1/2}$ (lux · sec) |
|---|---|---|---|
| 1 | $NO_2$ | 690 | 3.5 |
| 2 | H | 685 | 4.6 |
| 3 | $CH_3$ | 700 | 3.0 |
| 4 | Cl | 700 | 2.8 |

Comparative Example 5

An electrophotographic photosensitive member was prepared and evaluated in the same manner as in Example 4 except that the polyvinyl acetal resin used in Comparative Example 2 was used in place of the polyvinyl acetal resin used in Example 4. As the results, $V_0$ was −680 V, $E_{1/2}$ was 2.3 lux.sec, and Vr was −80 V.

EXAMPLE 6

The bisazo pigment used in Example 1 (4 g) was dispersed in 90 g of cyclohexanone for 20 hours by means of a sand mill. To this liquid dispersion, a solution of 20 g of the exemplified polyvinyl acetal resin No. 1 (weight average molecular weight 160,000) in 300 g of tetrahydrofuran was added, and the mixture was shaken for two hours. Further thereto, a solution of the styryl compound used in Example 1 (40 g) and the exemplified polyvinyl acetal resin No. 1 (20 g) in tetrahydrofuran(200 g) was added, and the mixture was shaken. The coating liquid thus prepared was applied with a Meyer bar onto an aluminum plate as a support, and dried to form an electrophotographic photosensitive member having a photosensitive layer of 20 μm thick.

This electrophotographic photosensitive member was tested for electrophotographic characteristics in the same manner as in Example 1 except that it was positively charged, and the Vr value was not measured. As the results, $V_0$ was −710 V and $E_{1/2}$ was 2.0 lux.sec.

EXAMPLES 7, 8, AND 9

The electrophotographic photosensitive members prepared in Examples 1, 2, and 3 were respectively attached onto a cylinder of an electrophotographic copying machine equipped with a −6.5 KV corona charger, a light-exposing system, a developer, a transfer-charger, a destaticizing light-exposing system, and a cleaning means. With this copying machine, the dark area potential ($V_D$) and light area potential ($V_L$) at the initial stage were set respectively at −700 V and at −200 V, and the changes of the dark-area potential ($\Delta V_D$) and of the light-area potential ($\Delta V_L$) after copying 5000 sheets were measured to evaluate the durability characteristics.

The results are shown in Table 2, where the negative value of the potential change denotes the decrease of the absolute value of the potential and the positive value of the change denotes the increase of the absolute value of the potential.

TABLE 2

| Example No. | $\Delta V_D$ (V) | $\Delta V_L$ (V) |
|---|---|---|
| 7 | 5 | 0 |
| 8 | 0 | 5 |
| 9 | −5 | 5 |

Comparative Examples 6, 7, and 8

The electrophotographic photosensitive members prepared in Comparative Examples 1 to 3 were tested for potential change in repeated use in the same manner as in Example 7. The results are shown in Table 3.

TABLE 3

| Comparative Example No. | $\Delta V_D$ (V) | $\Delta V_L$ (V) |
|---|---|---|
| 6 | −70 | 55 |
| 7 | −80 | 60 |
| 8 | −55 | 30 |

EXAMPLE 10

An electrophotographic photosensitive member was prepared in the same manner as in example 1 except that the charge-generating layer and the charge-transporting layer employed in Example 3 were formed in the reverse order. The resulting electrophotographic photosensitive member was evaluated by testing the charging characteristics in the same manner as in Example 1 except that it was positively charged, and Vr was not measured. As the results, $V_0$ was 700 V, and $E_{1/2}$ was 1.5 lux.sec.

EXAMPLE 11

An electrophotographic photosensitive member was prepared in the same manner as in Example 1 except that as the coating liquid for the charge-transporting layer a solution of 5 g of 2,4,5-trinitro-9-fluorenone and 5 g of polycarbonate resin (number-average molecular weight: 300,000) in 50 g tetrahydrofuran was used. The resulting electrophotographic photosensitive member was tested for charging characteristics in the same manner as in Example 1 except that it was positively charged and Vr was not measured. As the results $V_0$ was 690 V, and $E_{1/2}$ was 2.0 lux.sec.

As described above, the electrophotographic photosensitive member of the present invention, which has a photosensitive layer containing as the binder resin, a specified polyvinyl acetal resin having fluorine atoms or trifluoromethyl groups as the binder resin, exhibits high sensitivity, and excellent potential stability even when the member is repeatedly used.

What is claimed is:

1. An electrophotographic photosensitive member, comprising an electroconductive support and a photosensitive layer formed thereon, said photosensitive layer comprising a resin having an acetal moiety represented by the formula below:

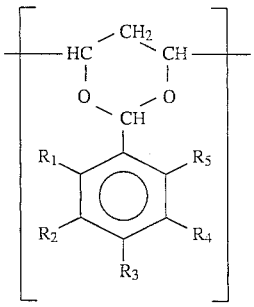

[I]

wherein $R_1$, $R_2$, $R_3$, $R_4$, and $R_5$ are each selected from the group consisting of a hydrogen atom, a fluorine atom, and a trifluoromethyl group, and $R_1$, $R_2$, $R_3$, $R_4$, and $R_5$ are not simultaneously hydrogen atoms.

2. An electrophotographic photosensitive member according to claim 1, wherein $R_3$ is a fluorine atom or a trifluoromethyl group.

3. An electrophotographic photosensitive member according to claim 1, wherein $R_3$ is a fluorine atom or a trifluoromethyl group, and $R_1$, $R_2$, $R_4$, and $R_5$ are hydrogen atoms.

4. An electrophotographic photosensitive member according to claim 1, wherein the photosensitive layer comprises a charge-generating layer and a charge-transporting layer.

5. An electrophotographic photosensitive member according to claim 4, wherein said electrophotographic photosensitive member has an electroconductive support, with said charge-generating layer formed thereon, and with said charge-transporting layer formed on said charge-generating layer.

6. An electrophotographic photosensitive member according to claim 4, wherein said electrophotographic photosensitive member has an electroconductive support, with said charge-transporting layer formed thereon, and with said charge-generating layer formed on said charge-transporting layer.

7. An electrophotographic photosensitive member according to claim 4, wherein said charge-generating layer contains a resin having the acetal moiety represented by the formula [I].

8. An electrophotographic photosensitive member according to claim 1, wherein said photosensitive layer comprises a single layer.

9. An electrophotographic photosensitive member according to claim 1, wherein said electrophotographic photosensitive member has a subbing layer located between said electrophotographic support and said photosensitive layer.

10. An electrophotographic photosensitive member according to claim 1, wherein said electrophotographic photosensitive member has a protecting layer formed on said photosensitive layer.

11. An electrophotographic apparatus, comprising an electrophotographic photosensitive member, a means for forming an electrostatic latent image, a means for developing the electrostatic latent image formed, and a means for transferring a developed image onto a transfer-receiving material;

said electrophotographic photosensitive member comprising an electroconductive support and a photosensitive layer formed thereon, wherein said photosensitive layer comprises a resin having an acetal moiety represented by the formula [I] below:

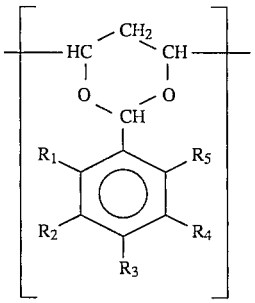

[I]

wherein $R_1$, $R_2$, $R_3$, $R_4$, and $R_5$ are each selected from the group consisting of a hydrogen atom, a fluorine atom, and a trifluoromethyl group, and $R_1$, $R_2$, $R_3$, $R_4$, and $R_5$ are not simultaneously hydrogen atoms.

12. An apparatus unit comprising an electrophotographic photosensitive member, and at least one of a charging means, a developing means, and a cleaning means;

said electrophotographic photosensitive member comprising an electroconductive support and a photosensitive layer formed thereon, wherein said photosensitive layer comprises a resin having an acetal moiety represented by the formula [I] below:

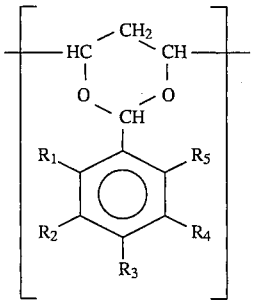

[I]

wherein $R_1$, $R_2$, $R_3$, $R_4$, and $R_5$ are each selected from the group consisting of a hydrogen atom, a fluorine atom, and a trifluoromethyl group, and $R_1$, $R_2$, $R_3$, $R_4$, and $R_5$ are not simultaneously hydrogen atoms; and said apparatus unit supporting integrally said electrophotographic photosensitive member and said at least one of said charging means, said developing means, and said cleaning means, and said apparatus unit being removable from a main body of an electrophotographic apparatus.

13. A facsimile machine, comprising an electrophotographic apparatus and a signal-receiving means for receiving image information from a remote terminal;

said electrophotographic apparatus comprising an electrophotographic photosensitive member, said electrophotographic photosensitive member comprising an electroconductive support and a photosensitive layer formed thereon, wherein said photosensitive layer comprises a resin having an acetal moiety represented by the formula [I] below:

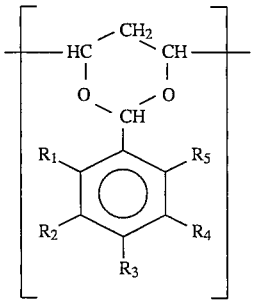

[I]

wherein $R_1$, $R_2$, $R_3$, $R_4$, and $R_5$ are each selected from the group consisting of a hydrogen atom, a fluorine atom, and trifluoromethyl group, and $R_1$, $R_2$, $R_3$, $R_4$, and $R_5$ are not simultaneously hydrogen atoms.

* * * * *

UNITED STATES PATENT AND TRADEMARK OFFICE

CERTIFICATE OF CORRECTION

PATENT NO. : 5,453,342

DATED : September 26, 1995

INVENTOR(S) : SHINTETSU GO, ET AL.

It is certified that error appears in the above-identified patent and that said Letters Patent is hereby corrected as shown below:

ON TITLE PAGE

In [56] References Cited, under FOREIGN PATENT DOCUMENTS:
"1239562 should read --1-239562
2146551" 2-146551--.

COLUMN 1

Line 37, "the the" should read --the--.
Line 49, "photoelectrography," should read --electrophotography,--.

COLUMN 3

Line 20, "understood" should read --understood that--.

COLUMN 5

Line 57, "Shown" should read --shown--.

COLUMN 6

Line 45, "above mentioned" should read --above-mentioned--.

COLUMN 7

Line 3, "diphenylhydrozone" should read --diphenylhydrazone--.

UNITED STATES PATENT AND TRADEMARK OFFICE

CERTIFICATE OF CORRECTION

PATENT NO. : 5,453,342

DATED : September 26, 1995

INVENTOR(S) : SHINTETSU GO, ET AL.

It is certified that error appears in the above-identified patent and that said Letters Patent is hereby corrected as shown below:

COLUMN 8

Line 48, "and" should be deleted.
Line 51, "above described" should read --above-described--.

COLUMN 9

Line 9, "entire" should read --entirety--.

COLUMN 10

Line 34, "potential (VF)." should read --potential (Vr).--.
Line 36, "VF" should read --Vr--.

COLUMN 12

Line 65, "75-80% Vr" should read --75-80%. Vr--.

COLUMN 14

Line 18, "example 1" should read --Example 1--.
Line 49, "formula" should read --formula [I]--.

UNITED STATES PATENT AND TRADEMARK OFFICE

CERTIFICATE OF CORRECTION

PATENT NO. : 5,453,342

DATED : September 26, 1995

INVENTOR(S) : SHINTETSU GO, ET AL.

It is certified that error appears in the above-identified patent and that said Letters Patent is hereby corrected as shown below:

COLUMN 16

Line 61, "trifluoromethyl" should read --a trifluoromethyl--.

Signed and Sealed this

Twenty-seventh Day of February, 1996

Bruce Lehman

*Attest:*

BRUCE LEHMAN

*Attesting Officer*

*Commissioner of Patents and Trademarks*